United States Patent [19]

Groger

[11] Patent Number: 4,943,120

[45] Date of Patent: Jul. 24, 1990

[54] FORCE TRANSMITTING HOUSING FOR LONGWALL MINING MACHINE

[75] Inventor: Hans Groger, Essen, Fed. Rep. of Germany

[73] Assignee: Gebr. Eickhoff Maschinenfabrik u. EisengieBerei, Fed. Rep. of Germany

[21] Appl. No.: 199,390

[22] Filed: May 27, 1988

[30] Foreign Application Priority Data

Jun. 2, 1987 [DE] Fed. Rep. of Germany ..... 3718442

[51] Int. Cl.[5] ..... E21C 29/22; E21C 29/28

[52] U.S. Cl. ..... 299/42; 105/29.1

[58] Field of Search ..... 299/42, 43, 53, 54; 105/29 R

[56] References Cited

U.S. PATENT DOCUMENTS

| | | | |
|---|---|---|---|
| 3,594,043 | 7/1971 | Weber et al. | 299/42 |
| 4,236,758 | 12/1980 | Groger | 299/42 |
| 4,465,319 | 8/1984 | Brownlie | 299/42 |

FOREIGN PATENT DOCUMENTS

| | | | |
|---|---|---|---|
| 2925240 | 1/1981 | Fed. Rep. of Germany . | |
| 2935643 | 11/1982 | Fed. Rep. of Germany . | |
| 1208224 | 1/1986 | U.S.S.R. | 299/42 |

OTHER PUBLICATIONS

"Double Ended Ranging Drum Shearer", Mining Supplies Limited, 1980, p. 7.

*Primary Examiner*—Stephen J. Novosad
*Assistant Examiner*—David J. Bagnell
*Attorney, Agent, or Firm*—Clifford A. Poff

[57] ABSTRACT

An improved drum-cutter mining machine design which transmits force exerted upon a drive wheel during translation of the mining machine along a rack structure to the machine. A protective housing encloses gears and a drive wheel in a manner such that feed forces exerted upon a drive wheel are transmitted through the housing to the mining machine.

12 Claims, 5 Drawing Sheets

FORCE TRANSMITTING HOUSING FOR LONGWALL MINING MACHINE

BACKGROUND OF THE INVENTION

1. Field of the Invention

The present invention relates generally to drum-cutter mining machines, and, more particularly, to a mining machine containing a housing assembly housing connecting gears which connect the mining machine to a drive wheel which engages with a rack or chain affixed to a longwall conveyer.

2. Description of the Prior Art

Conventional longwall mining procedures typically utilize drum-cutter mining machines to shear a mineral from a mine wall, such mineral being transported on a longwall conveyer which extends along the length of the mine wall. The drum-cutter mining machine includes at least one, and usually two circular cutting drums which extend from opposite ends of the mining machine.

The drum-cutter mining machine is translatable along the length of the mine wall face by engagement of the mining machine with a pinwheel rack structure affixed to the longwall conveyer. A drive wheel of the mining machine meshingly engages with the rack structure to transmit feed forces to allow translation of the mining machine therealong.

One such drum-cutter mining machine is disclosed in a brochure entitled "Doubled Ended Ranging Drum Shearer" of Mining Supplies Limited No. 1180/19, page 7. The mining machine disclosed therein contains a capstan position on a coal-face side (i.e. mine wall face side) of a longwall conveyer, and contains a capstan housing which covers the output shaft butt of a drive motor supported in the capstan with the housing extending along the capstan as far as the plane of the rack structure. Positioned within the housing are spur gears which meshingly engage with the output shaft butt of the drive motor and which also meshingly engage with the drive wheel. The drive wheel, in turn, engages with the rack structure to allow translation of the mining machine therealong. The drive wheel is positioned outside of the housing, is axially to a spur gear, and the housing may be connected to the sidewall of the capstan and any of various swiveling positions.

Also disclosed in the prior art is West German Patent No. DE-PS 2935643 which discloses a substructure for a mining machine wherein the height of the substructure is adjustable. The substructure also carries drive wheels above the rack structure. Wheel cases may also be affixed with the bearings for the drive wheels at varying heights of the substructure of the machine.

Further, West German Patent No. DE OS 2925240 discloses a drum-cutter mining machine which includes a machine frame having at least one end plate which is provided with a drive wheel wherein the drive wheel may be connected to the machine frame in any various height positions. The end plate, which is U-shaped, is positioned such that the two ends thereof rest against the machine frame, thereby enclosing the drive wheel. The drive wheel meshingly engages with an intermediate gear wheel which is positioned to rotate in conjunction with rotation of an output shaft butt of the drive motor supported in the capstan. Several groups of bores extending into the machine frame allow the end plate to be fastened to the machine frame, and the drive wheel supported thereby, in any of various height positions to thereby set the drive wheel at a desired height to allow engagement with the rack structure.

In most instances, the drive wheel which engages with the rack structure contains teeth members to allow meshing engagement with the reduction gears. On the drive wheel side facing the mining machine, the drive wheel is enclosed by a plate member carrying the forces exerted on the drive wheel, and is swivelably mounted about the axis of the reduction gears of the capstan, and may be fixed in various swivelling positions, in order to allow the drive wheel to engage with the rack structure at a desired height (see, for example DE-PS2714532).

Because the drum-cutter mining machines utilized in longwall mining operations are quite heavy, the feed forces required to rotate the drive wheel to allow translation of the mining machine along the rack structure is commonly quite high, and, in some instances, may reach or exceed 300 kilonewtons. A stable and torsionally rigid of wheel support affixed to the sidewall of the capstan housing is therefore required in order to prevent individual teeth members of the drive wheel from fracturing during translation of the mining machine. Also, the high feed forces causes wearing of the drive wheel, thereby requiring frequent replacement of the drive wheel.

Also as result of the high feed forces, the reduction gears connecting the drive wheel to the drive motors must be frequently lubricated.

Therefore, the mining machine design must allow for quick replacement of the drive wheel, and, further, the reduction gears must be encapsulated in a fluid-tight compartment.

It is therefore the object of the present invention to provide a drum-cutter mining machine construction which allows for quick replacement of the drive wheel.

It is a further object of the present invention to provide a drum-cutter mining machine which allows the position of the drive wheel relative to the mining machine to be altered to allow use of the mining machine on various rack structure assemblies.

SUMMARY OF THE INVENTION

In accordance with the present invention, a drum-cutter mining machine for longwall mining operations is disclosed. The mining machine includes a machine body containing a capstan housing supported from the machine body wherein the capstan housing supports an internal drive motor means. The capstan housing contains at least one vertically extending sidewall positioned above the rack structure affixed to a longwall conveyer. A recessed area of the sidewall forms a cavity therealong. An aperture extending through the sidewall in the recessed area thereof allows an output shaft of the drive motor to extend therethrough. A housing is removably positioned to cover the recessed area of the sidewall, thereby forming an enclosed area. A fastening means removably connects the housing to the sidewall of the capstan housing, thereby fastening the housing to the sidewall in a desired orientation. Connecting gear means are positioned in the enclosed area formed by the housing and meshingly engage with the output shaft of the drive motor means. A drive wheel means is positioned to engage with the connecting gear means and to the rack structure affixed to the longwall conveyer.

In the preferred embodiment, the housing is comprised of a housing baseplate and a housing jacket, wherein the housing baseplate is positioned in the recessed area to abut the sidewall of the capstan housing, and the housing jacket is removably attached to the housing baseplate such that the housing jacket covers the recessed area of the sidewall to form the enclosed area thereby. The housing baseplate may further contain an aperture for allowing the output rotating shaft of the drive motor to extend therethrough.

In a further embodiment of the present invention, a guide shoe extends from the capstan housing to support the housing jacket and to enclose a bottom portion thereof. The guide shoe may include a groove and a spring member for connecting the guide shoe and the housing jacket together.

In a still further embodiment of the present invention, the housing jacket further includes a cylindrical shoulder portion extending from a face portion thereof for enclosing portions of the drive wheel positioned above the rack structure. The cylindrical shoulder portion may include a removable cover on a face portion thereof which extend across the diameter of the drive wheel and the width of the rack structure.

BRIEF DESCRIPTION OF THE DRAWINGS

The present invention will be better understood when read in light of the accompanying drawings in which.

DESCRIPTION OF THE PREFERRED EMBODIMENT

Figure 1:
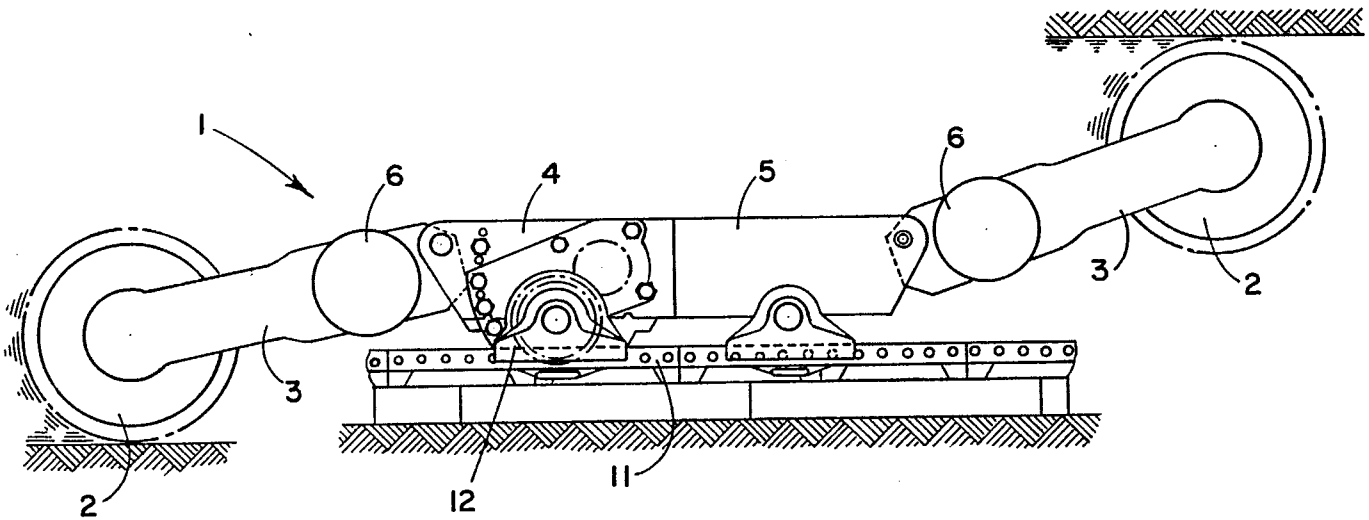
FIG. 1 is a side, elevational view of the drum-cutter mining machine of the present invention.

Referring to the side, elevational view of FIG. 1, there is shown a drum-cutter mining machine of the present invention, referred to generally by reference numeral 1. Mining machine 1 includes two cutting drums 2 which are rotatably supported from end portions of swivelable support arms 3. During longwall mining operations, cutting drums 2, when caused to rotate, shear a mineral from a mine wall face.

The machine body of the mining machine 1 is comprised of two structural units, capstan 4 and energy distribution means 5. Energy distribution means 5 is electrically coupled to an electrical supply cable (not illustrated), and distributes the electrical power supplied to it to drive motors 6 mounted on the support arms 3. Drive motors 6 are coupled through appropriate gearing to drive the respective cutting-drums 2. Energy distribution means 5 also supplies electrical power to electric drive motors (not illustrated) supported within the capstan 4.

Figure 2:
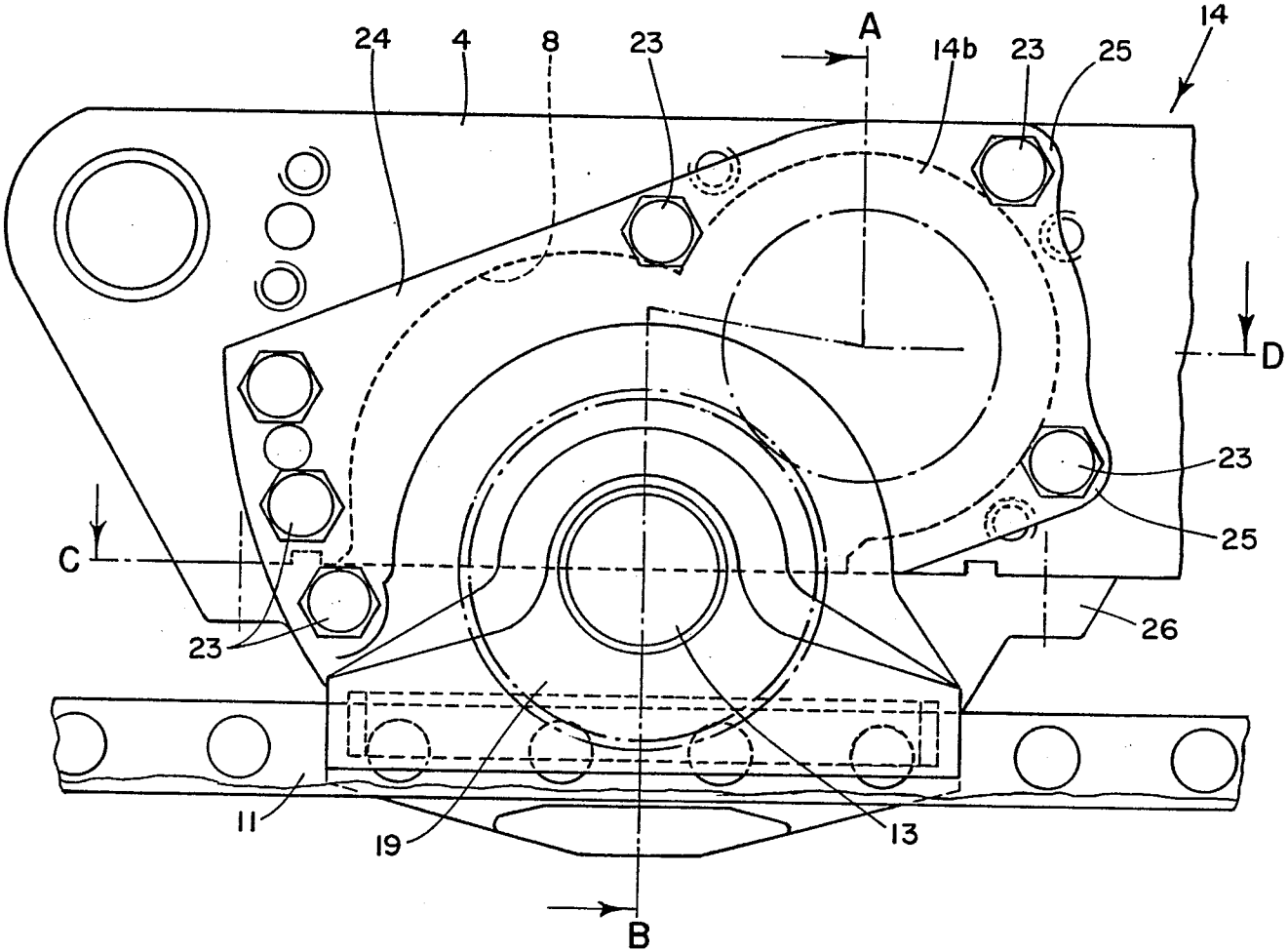
FIG. 2 is an enlarged, elevational view of one capstan housing of the drum-cutter mining machine of FIG. 1.
Figure 3:
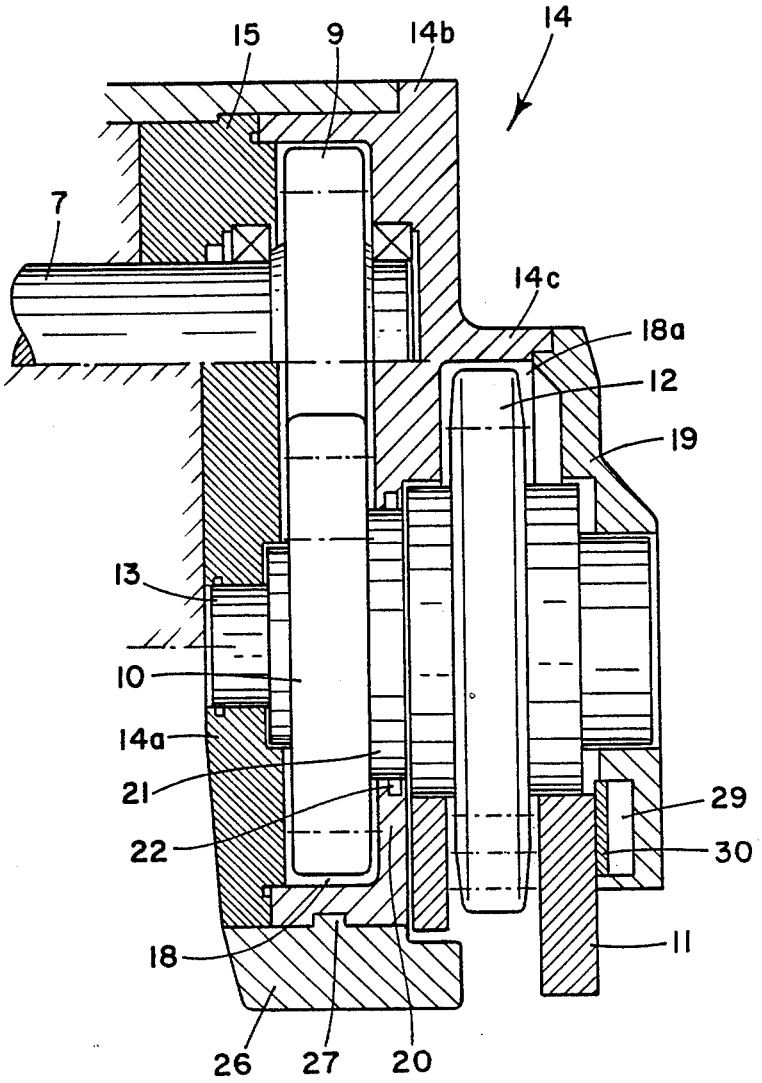
FIG. 3 is a sectional view taken along line A–B of FIG. 2.
Figure 4:
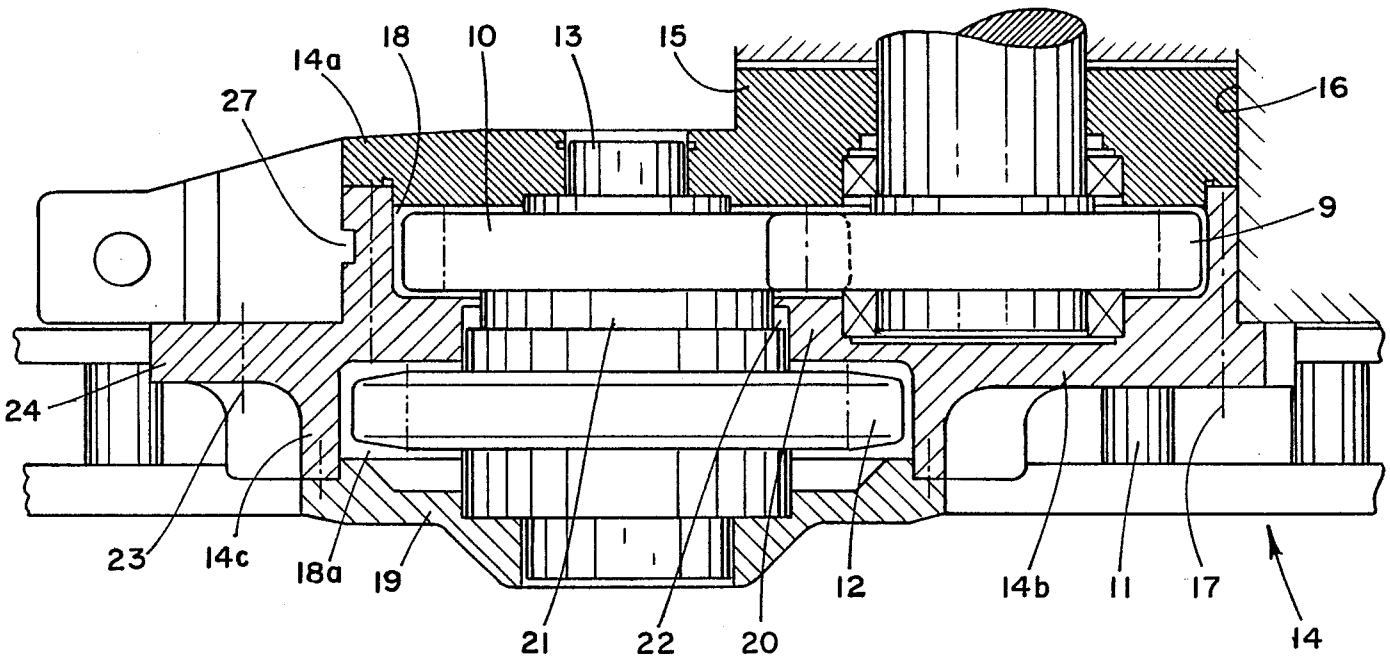
FIG. 4 is a sectional view taken along line C–D of FIG. 2.

Output shaft 7 (illustrated in the cross section of FIG. 3) which extends through an aperture of the sidewall of the capstan 4 is caused to rotate during operation of the electric drive motors. Preferably, output shaft 7 protrudes from a recessed area on the sidewall of the capstan 4, such recessed area forming cavity 8 (FIG. 2). Cavity 8 is of dimensions to allow spur gears 9 and 10 to be positioned therewithin. As best illustrated in the cross-sectional view of FIG. 3, spur gear 9 is mounted at an end portion of output shaft 7 and is caused to rotate therewith. Spur gear 10 is meshingly engaged with spur gear 9, and is also caused to rotate responsive to rotation of output shaft 7. Spur gear 10 is in an aligned relationship with drive wheel 12 along longitudinal axis 13 such that spur gear 10 and drive wheel 12 rotate in unison. Drive wheel 12, in turn, engages with rack 11 positioned proximate to a longwall conveyer (not illustrated) to cause translation of the mining machine. The area forming cavity 8 is deep enough such that, for the most part, spur gears 9 and 10 rest within the cavity 8.

Spur gear 9, spur gear 10, and drive wheel 12 are positioned in a common protective housing, referred to generally by reference numeral 14. Preferably, protective housing 14 is comprised of baseplate 14A, housing jacket 14B, and cylindrical shoulder 14C, and is removably fastened to the sidewall of the capstan 4 to enclose the recessed area forming cavity 8. Housing base plate 14A engages with the sidewall of the capstan 4 by way of collar 15 which extends into bore 16 extending into the sidewall of the capstan 4. Housing jacket 14B is mounted and centered upon base plate 14A and is fastened to baseplate 14A by screw members 17. Housing jacket 14B thereby forms a fluid-tight chamber 18 of cavity 8.

Extending from a side surface of housing jacket 14B is cylindrical jacket portion 14C which extends outwardly from the housing jacket 14B over the rack 11. Jacket shoulder portion 14C thereby forms the partially enclosed chamber 18A in which drive wheel 12 is positioned. An orifice formed on a side surface of cylindrical shoulder 14C is enclosed by removable cover 19 to enclose the orifice portion of cylindrical jacket portion 14C thereby.

Drive wheel 12 and spur gear 10 are separated from one another by intermediate wall portion 20 of the housing jacket 14B. Intermediate wall 20 functions to both enclose chamber 18, and, further, to support collar portion 21 and spur gear 10. Preferably, collar portion 21 is surrounded by seal 22 to ensure that a fluid-tight enclosure of chamber 18 is maintained.

In the preferred embodiment, the recessed area forming cavity 8 on the sidewall of the capstan 4 is of a larger dimension than the outer dimension of housing 14. This arrangement allows the housing 14 to be swiveled about the axis of the output shaft 7 to allow fastening of the housing 14 to the sidewall of the capstan in any of various orientations.

As best illustrated in the elevational view of FIG. 2, housing 14 is fastened to capstan 4 by screw members 23 which extend through a plurality of bores extending through housing flange 24. Additional screw members 25 may extend through bores or individual flanged mesh-shaped eyes 23 in the housing 14 which are positioned proximate to the output shaft butt 7.

Baseplate 14A and housing jacket 14B have dimensions corresponding to the circumferential dimensions of the spur gears 9 and 10. Because housing 14 is of a smaller dimension than cavity 8, a positive connection between capstan 4 and housing 14 is thereby allowed which is effective in the longitudinal direction of the machine. Because of this positive connection, there is no relative movement of housing 14, and forces exerted upon the drive wheel during translation of the mining machine 1 are transmitted through the housing 14 to the capstan 4.

In order to reduce the force exerted upon screw members 23 which connect housing 14 to the capstan 4, a guide shoe 26, illustrated in FIGS. 2–5 extends from the sidewall of the capstan 4 to support the bottom circular portion of housing 14. Guide shoe 26 is formed in a semi-circular shape corresponding to the bottom circular portion of housing 14. Guide shoe 26 also extends beneath a portion of rack 11. Forces exerted on housing 14 at angles perpendicular to the direction of travel of the machine are transmitted through the guide shoe 26 to the capstan 4.

Figure 5:
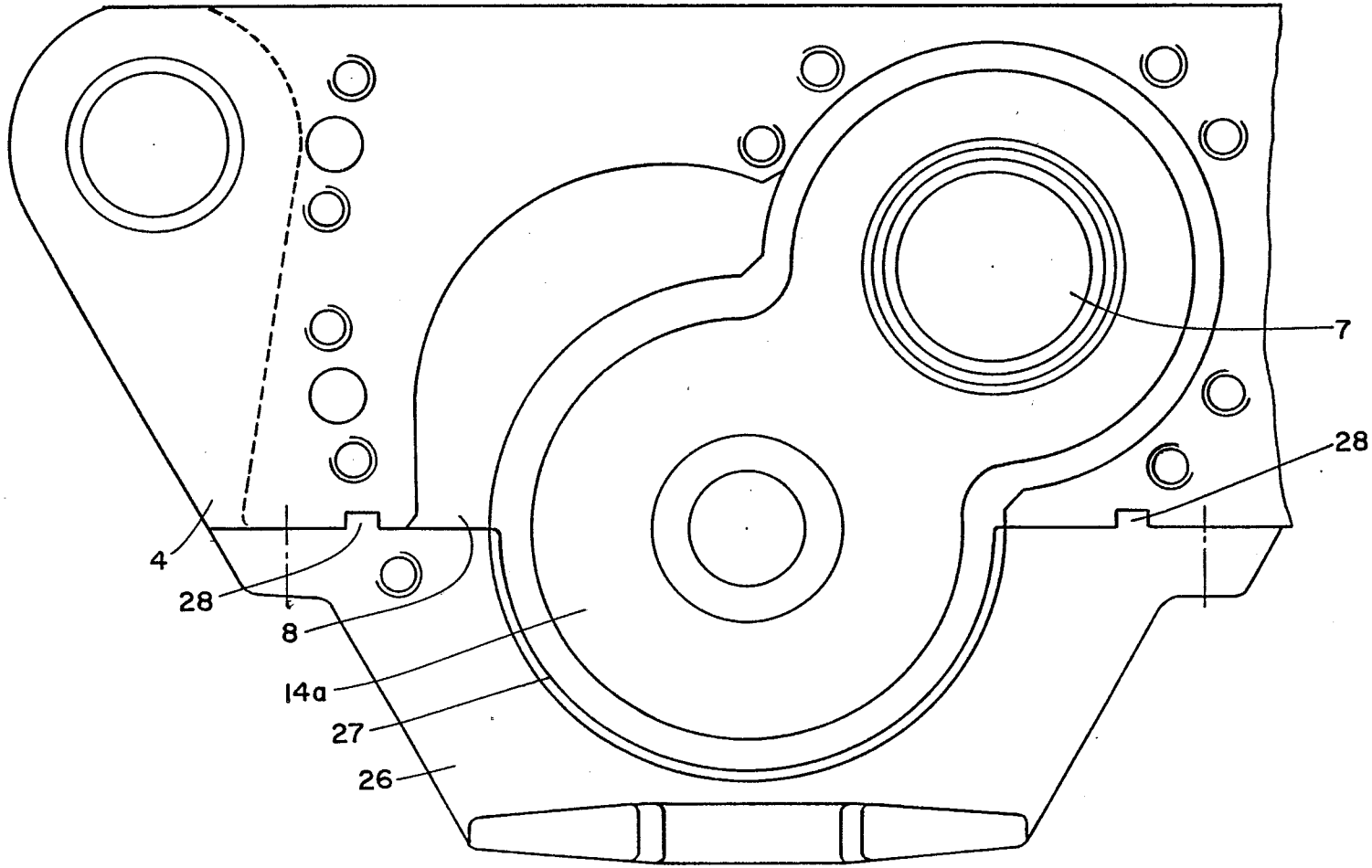
FIG. 5 is a side view of the capstan and the housing baseplate forming a portion of the present invention.

Spring 27 supported in a semi-circular groove formed on guide shoe 26 engages in a corresponding groove formed on a bottom portion of housing jacket 14B to thereby provide a positive connection between housing 14 and the guide shoe 26. Further, and as illustrated in FIG. 5, to further supportively connect guide shoe 26 to housing 14, are corresponding shaped-ends indicated by reference numeral 28. All forces exerted upon housing 14 in the longitudinal direction of the mine machine 1 are thereby transmitted to the capstan 4.

Cover 19 which encloses the orifice on the frontal portion of cylindrical portion 14C is of dimensions such that cover 19 extends beneath a vertical height of rack 11. Extending through cover 19, is cavity 29 which allows positioning therewithin of guide grip 30, preferably a leaf spring, which is curved in the direction of the rack 11, to thereby aid in the reduction of lateral movement play between rack 11 and drive wheel 12 during translation of mining machine 1 along rack 11.

Because spur gears 9 and lo are housed within housing 14 and, in particular, fluid-tight space 18 thereof, lubricating oil maybe injected into space 18 to maintain lubrication of the gears 9 and 10. Further, drive wheel 12 may be quickly and easily replaced by removing cover 19 without disturbing spur gears 9 and 10.

While the present invention has been described in connection with the preferred embodiments shown in the various figures, it is to be understood that other similar embodiments may be used or modifications and additions may be made to the described embodiment for performing the same functions of the present invention without the deviating therefrom. Therefore, the present invention should not be limited to any single embodiment, but rather construed in breadth and scope in accordance with the recitation of the appended claims.

What is claimed is:

1. A drum-cutter mining machine for longwall mining operations in which the drum-cutter mining machine is translatable along a longwall conveyor, said mining machine including:

a machine body;

a capstan supported from said machine body, said capstan supporting internal drive motor means and said capstan forming a vertically extending sidewall positioned above the longwall conveyor;

a recessed area forming a cavity on said sidewall of the capstan;

an aperture extending through the recessed area of the sidewall for allowing an output shaft butt of the drive motor means to extend therethrough;

a housing removably positioned in the recessed area of the sidewall, said housing forming an enclosed area therein;

means for fastening the removable housing to the sidewall of the capstan in a plurality of desired orientations;

gear means positioned in said enclosed area connected with the output shaft butt of the drive motor means; and drive wheel means connected with said gear means and positionable to engage a conveyance means to allow translation of the mining machine therealong.

2. The drum-cutter mining machine of claim 1 wherein said enclosed area of said housing forming a first chamber, said first chamber being fluid-tight and supporting the gear means therewithin, said housing further forming a second chamber, said second chamber having open side and bottom surfaces and supporting the drive wheel means therewithin.

3. The drum-cutter mining machine of claim 2, wherein said housing is comprises of a housing baseplate and a housing jacket, wherein said housing baseplate is positioned in said recessed area to abut the sidewall of the capstan, and said housing jacket is removably attached to the housing baseplate.

4. The drum-cutter mining machine of claim 3 further including a guide shoe extending from the capstan for supporting the housing jacket.

5. The drum-cutter mining machine of claim 4, wherein a portion of said guide shoe extends under a portion of said conveyance means.

6. The drum-cutter mining machine of claim 4 wherein said housing jacket includes a cylindrical shoulder portion extending from a face portion of the housing jacket for enclosing the open side surface of the second chamber.

7. The drum-cutter mining machine of claim 6 wherein said cylindrical shoulder portion includes a removable cover on a frontal face portion thereof, said removable cover extending across the diameter of the drive wheel.

8. The drum-cutter mining machine of claim 7, wherein said removable cover includes a guiding means thereon for engaging said conveyance means and serving to guide said drive wheel means relative to the conveyance means during translation of the mining machine along the conveyance means.

9. The drum-cutter mining machine of claim 7 wherein said gear means is comprises of a first spur gear and a second spur gear, wherein said first spur gear is mounted upon an end portion of the output shaft butt to rotate therewith, and said second spur gear is positioned beneath the first spur gear to meshingly engage therewith.

10. The drum-cutter mining machine of claim 9 wherein said drive wheel means is positioned in-line with a longitudinal axis of the second spur gear and caused to rotate in unison therewith.

11. The drum-cutter mining machine of claim 1, wherein said recessed area is of larger dimension than the outer dimension of said housing and said housing is pivotable about the central axis of the output shaft butt.

12. The drum-cutter mining machine of claim 11, wherein said means for fastening includes flange means provided on said housing, said flange means provided with a plurality of bores therethrough;

a plurality of mating bores in said capstan; and fastener means insertable through said bores and said mating bores for fastening the housing to the sidewall of the capstan in any one of said plurality of desired orientations.

* * * * *